US009447640B2

(12) United States Patent
Kvalvik

(10) Patent No.: US 9,447,640 B2
(45) Date of Patent: Sep. 20, 2016

(54) DIRECTIONAL DRILLING TOOL WITH ECCENTRIC COUPLING

(71) Applicant: 2TD Drilling AS, Aalgaard (NO)

(72) Inventor: Tore Kvalvik, Stavanger (NO)

(73) Assignee: NABORS LUX FINANCE 2 SARL, Luxembourg (LU)

( * ) Notice: Subject to any disclaimer, the term of this patent is extended or adjusted under 35 U.S.C. 154(b) by 273 days.

(21) Appl. No.: 14/146,735

(22) Filed: Jan. 3, 2014

(65) Prior Publication Data

US 2015/0191978 A1 Jul. 9, 2015

(51) Int. Cl.
*E21B 17/046* (2006.01)
*E21B 7/06* (2006.01)

(52) U.S. Cl.
CPC *E21B 7/06* (2013.01); *E21B 7/062* (2013.01)

(58) Field of Classification Search
CPC ..... E21B 7/062; E21B 7/067; E21B 17/046; E21B 17/1057; E21B 17/1078; E21B 17/20; E21B 17/042
See application file for complete search history.

(56) References Cited

U.S. PATENT DOCUMENTS

| | | | | |
|---|---|---|---|---|
| 2,515,366 | A * | 7/1950 | Zublin | 464/19 |
| 6,053,922 | A * | 4/2000 | Krause et al. | 606/80 |
| 6,092,610 | A | 7/2000 | Kosmala et al. | |
| 6,234,259 | B1 * | 5/2001 | Kuckes et al. | 175/73 |
| 6,581,699 | B1 | 6/2003 | Chen et al. | |
| 2002/0175003 | A1 | 11/2002 | Pisoni et al. | |
| 2002/0185314 | A1 | 12/2002 | Cargill et al. | |
| 2003/0034178 | A1 * | 2/2003 | Cargill et al. | 175/73 |
| 2009/0050370 | A1 * | 2/2009 | Peters | 175/45 |
| 2010/0000794 | A1 | 1/2010 | Hall et al. | |
| 2010/0065333 | A1 | 3/2010 | Kiyosawa | |
| 2010/0236830 | A1 * | 9/2010 | Haughom | 175/76 |

FOREIGN PATENT DOCUMENTS

| | | | |
|---|---|---|---|
| WO | 9631679 | A1 | 10/1996 |
| WO | 2008156375 | A1 | 12/2008 |
| WO | 2012152914 | A2 | 11/2012 |

OTHER PUBLICATIONS

International Search Report and Written Opinion issued in PCT/EP2014/078668, dated Jul. 13, 2015, 11 pages.

* cited by examiner

*Primary Examiner* — Kipp Wallace
(74) *Attorney, Agent, or Firm* — Adolph Locklar

(57) ABSTRACT

A directional drilling tool which comprises a pair of shafts with an eccentric bore to vary the radial position of a stabilizer, such tool including one or more eccentric couplings which are used to transmit torque between a pair of elements of the tool which are intended to be movable relative to each other in a direction transverse to their longitudinal axes.

20 Claims, 4 Drawing Sheets

DIRECTIONAL DRILLING TOOL WITH ECCENTRIC COUPLING

FIELD

The present invention relates to a drill string section for use in directional drilling. When drilling oil and/or gas wells, it will often be necessary to guide the drilling tool in a desired direction. This is the case, for example, in connection with directional wells which may have a substantial deviation from a vertical direction. It is also the case, as an additional example, when drilling horizontal wells within a formation to enable the well to reach the desired geological target(s).

Directional control during drilling can be effected by applying a radial force to the drilling bit which is designed to drive the bit in a desired direction in relation to the center axis of the bit.

There are various existing designs for sections of the drilling string for controlling the direction of a well while it is being drilled. It is known that deviations in the direction of the wellbore can be induced in two ways: either by so-called (i) "point-the-bit" methods, in which the longitudinal axis of the drill bit is "tilted" or "pointed" in a desired drilling direction, or (ii) "push-the-bit" methods, in which the drill bit is pushed in a radial direction, (i.e., sideways).

DESCRIPTION OF RELATED ART

Examples of "point-the-bit" solutions are described in U.S. Pat. Nos. 6,092,610 and 6,581,699.

A known "push-the-bit" device is described in PCT International Publication No. WO 2008/156375, where three steering bodies are used that are arranged around the drilling tool in the circumferential direction and are movable in a radial direction in order to push the drill bit in the desired direction.

PCT International Publication No. WO 96/31679 teaches the use of two eccentric shafts for adjustment of drilling deviation.

PCT International Publication No. WO 2012/152914, which is hereby incorporated by reference in its entirety, relates to a previous directional drilling invention by applicant. The invention disclosed in PCT International Publication No. WO 2012/152914 also uses a pair of shafts, each having an eccentric bore, to "push the bit" in a radial direction to cause a deviation in the direction of the wellbore. In the embodiments shown in PCT International Publication No. WO 2012/152914, certain parts in the directional drilling tool may be subjected to radial forces along their length which could result in a limited amount of bending or deformation of such parts.

SUMMARY

The present invention is an improvement to the invention disclosed in PCT International Publication No. WO 2012/152914. In the present invention, one or more specially designed couplings are used to transmit torque between elements of the directional drilling tool which are intended to be movable relative to each other in a direction transverse to their longitudinal axes. Use of such a coupling radially isolates such elements from each other to a limited extent. This permits such elements to move radially to a limited extent with respect to each other without deformation while continuing to transmit torque. This reduces stresses which otherwise could occur in the tool.

The present invention is directed to a directional drilling tool comprising (i) a variable position stabilizer; (ii) an outer sleeve having an eccentric bore; (iii) an inner sleeve having an eccentric bore which is disposed inside the bore of said outer sleeve, wherein the radial position of said stabilizer may be adjusted by relative rotation of said outer sleeve and said inner sleeve; (iv) a drive shaft having a longitudinal bore which is disposed inside the bore of said inner sleeve; and (v) an eccentric coupler comprising first, second, and third coupler sleeves, a first complementary tab and groove set which may transmit torque between said first coupler sleeve and said second coupler sleeve, and a second complementary tab and groove set which may transmit torque between said second coupler sleeve and said third coupler sleeve, wherein the grooves of said second complementary tab and groove set are orthogonal to the grooves of said first complementary tab and groove set.

DETAILED DESCRIPTION

A detailed description of various embodiments of the invention is provided below along with accompanying figures that illustrate the principles of the invention. The invention is expressly not limited to or by any or all of the embodiments shown or described herein; the scope of the invention is limited only by the claims appended to the end of the issued patent and the invention encompasses numerous alternatives, modifications, and equivalents. Specific details may be set forth in the following description to facilitate a more thorough understanding of the invention. However, such details are provided for the purpose of example and the invention may be practiced according to the claims without these specific details.

Figure 1:
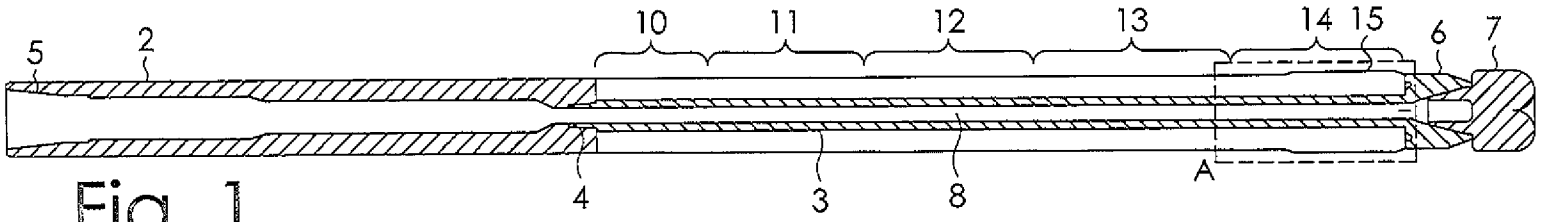
FIG. 1 is a partial cross-sectional view of an embodiment of the direction drilling tool, showing the drive shaft extending through the tool from the upper housing to the drill bit.

FIG. 1 shows an embodiment of the directions drill tool 1. Referring to FIG. 1, the lower end of the upper housing 2 is connected to the upper end of the drive shaft 3 by a threaded connection 4 or other suitable connection which permits the upper housing 2 to transmit torque and axial loads (tension and compression) to the drive shaft 3. For purposes of the descriptions contained herein, the term "lower end" when used with respect to an element of the drilling string shall refer to the distal end from the surface when in the well, while the term "upper end" shall refer to the proximal end to the surface when in the well, it being understood the well may contain sections which are horizontal or otherwise deviate from vertical.

In other embodiments, the upper housing may be an integral part of the drive shaft. The upper end of the upper housing 2 has a threaded connection 5 to connect the remainder of the drilling string (not shown) to the directional drilling tool 1.

The lower end of the drive shaft has a threaded bit box 6 which permits the drill bit 7 to be connected to the lower end of the drive shaft. The upper housing 2 and the drive shaft 3 include a longitudinal bore 8 which extends through the directional drilling tool 1 to permit the flow of drilling fluids through the tool to the drill bit 7.

A source of torque typically is applied to the drill string from a source above the directional drilling tool 1. The source of torque may be a rotary table or other drive (not shown) at the surface of the well or a drilling motor (not shown) located in the well at a location above the directional drilling tool 1. The applied torque causes the drive shaft 3 to rotate, which in turn cause the drill bit 7 to rotate while drilling.

In the embodiment shown, the direction drilling tool has sections which contain equipment used to perform various functions. Section 10 may contain equipment which receives and decodes signals from the surface to control the operation of the directional drilling tool 1, such as the direction in which a radial force is to be applied to the drill bit 7 to cause a deviation in the drilling direction. Section 11 may contain the motor and associated drive train used to adjust (rotate) the outer eccentric sleeve in response to control signals received or generated by the tool and section 13 may contain the motor and associated drive train used to adjust (rotate) the inner eccentric sleeve in response to control signals received or generated by the tool. This may be accomplished in the manner described in more detail in PCT International Publication No. WO 2012/152914. The motors may be either electrically or hydraulically powered, depending on the embodiment. Section 12 may contain the batteries or other power source (such as a hydraulic power source) for the motors in sections 11 and 13. The locations of these various elements may, of course, be varied depending on the actual embodiment of the invention.

Section 14 near the lower end of the directional drilling tool 1 contains the variable position stabilizer 15 which may be positioned to control the magnitude and direction of the radial force to be applied to the drill bit to cause a deviation in the drilling direction. Referring to FIG. 4A, the stabilizer shown in this embodiment has a plurality of stabilizer blades 16 and a plurality of flow passages 17 between the blades 16. In the embodiment shown in FIG. 4A, there are six blades; however, a larger or smaller number of blades may be used depending on the design and spacing desired. Moreover, the relative widths of the blades and the flow passages may be varied depending on the desired cross-sectional area for the flow passages and the desired engagement of the blades with the borehole wall.

The diameter of variable position stabilizer 15 measured across diametrically opposing blades 16 is only slightly smaller than the diameter of drill bit 7 and the borehole drilled by drill bit 7. The flow passages 17 between the blades 16 enable drilling fluid which exits from the drill bit 7 to return to the surface through the annulus between the drillstring and the wall of the borehole.

Blades 16 and flow passages 17 may extend parallel to the longitudinal axis of the tool. Alternatively, blades 16 and flow passages 17 may wrap around the tool in a spiral pattern, which would distribute the available stabilization over the entire circumference of the tool and avoid high and low areas in the cross-sectional profile of the stabilizer over its length.

The stabilizer 15 typically would not rotate during drilling, but instead may be positioned to stabilize the existing drilling direction or to engage the wall of the borehole to exert a radial force on the drill bit to cause a directed deviation in the drilling direction, as described in greater detail below.

Figure 2:
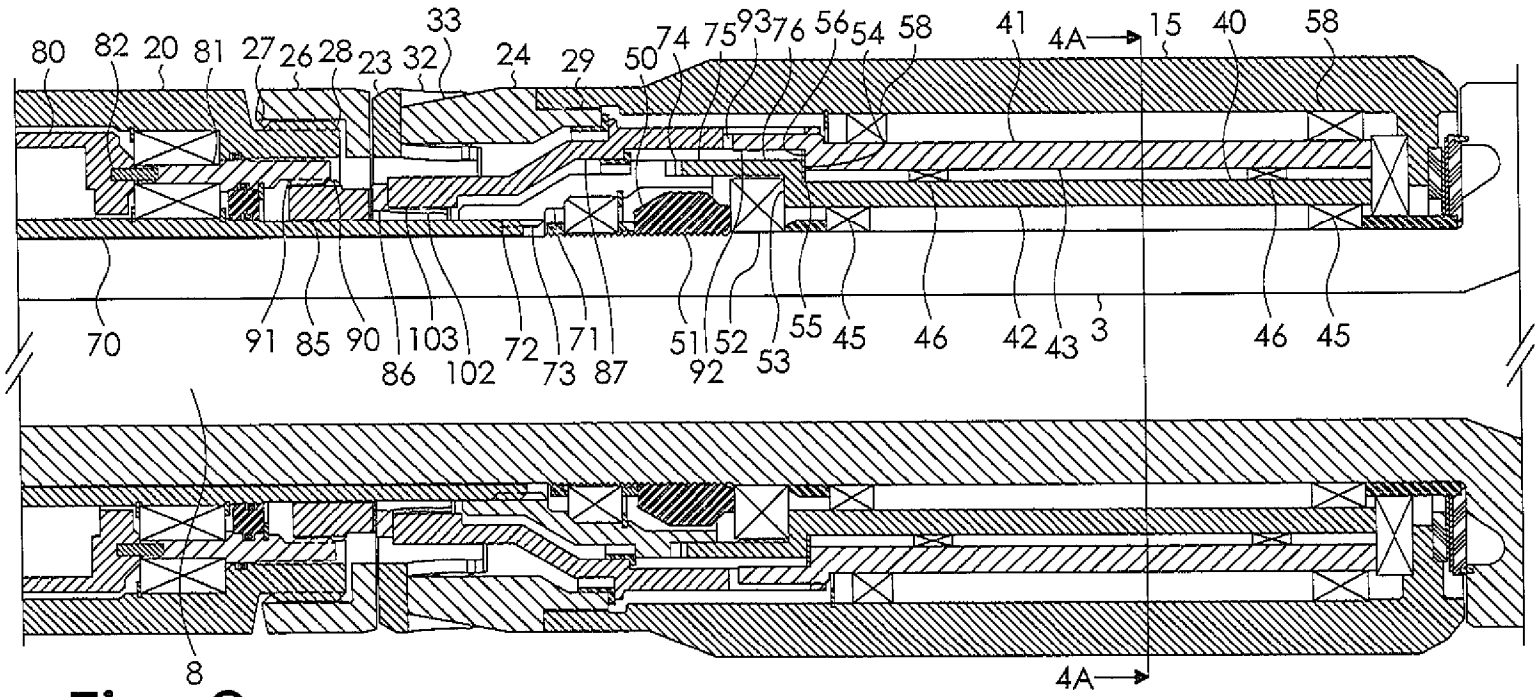
FIG. 2 is an enlarged cross-sectional view of that portion of FIG. 1 bound by rectangle A in FIG. 1.

FIG. 2 includes an enlarged cross-sectional view of the variable position stabilizer and its positioning mechanism, including the eccentric couplings used in the invention.

Figure 3:
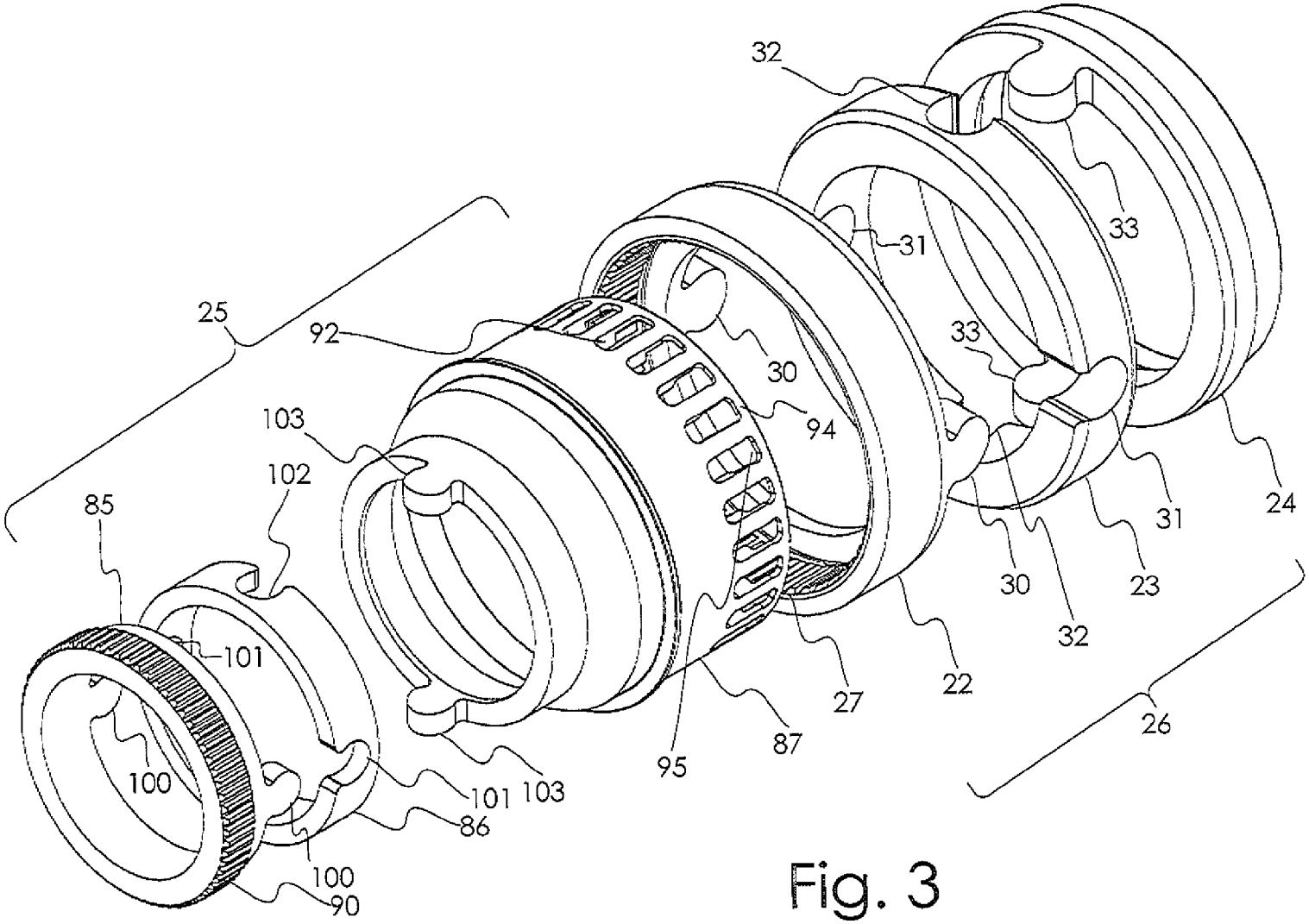
FIG. 3 is an exploded view of an embodiment of the two eccentric couplings used in the invention.

An outer eccentric coupling 26 is used to connect the intermediate outer housing 20 to the variable position stabilizer sleeve 15. Referring to FIGS. 2 and 3, the outer eccentric coupling 26 is comprised of three sleeves—a first outer coupling sleeve 22, a second outer coupling sleeve 23, and a third outer coupling sleeve 24. The term "sleeve" as used herein is not limited to a cylindrical sleeve, but may include more complex shapes which are at least somewhat radially symmetrical and have a longitudinal passageway therethrough.

The outer eccentric coupling is adapted to be mounted between two elements which (i) have generally parallel longitudinal axes, and (ii) need to be able to transmit torque between each other, such as the intermediate outer housing 20 and the variable position stabilizer 15. Rotation of one of the two elements will cause the other element to rotate or, alternatively, when one of the two elements does not rotate, the other is constrained against rotation. Torque may be transmitted through the outer eccentric coupling from the intermediate outer housing 20 and the variable position stabilizer 15 and vice versa.

In the embodiment shown, first outer coupling sleeve 22 has a set of splines 27 which engage a complementary set of splines 28 on intermediate outer housing 20. Alternatively, first outer coupling sleeve 22 may be connected to intermediate outer housing 20 by welding, a threaded connection (threaded in a direction appropriate to permit the torque expected to be transmitted through the coupling), or other suitable means of attachment. Alternatively, first outer coupling sleeve 22 may be formed as an integral part of intermediate outer housing 20.

In the embodiment shown, third outer coupling sleeve 24 is connected to variable position stabilizer 15 by a threaded connection 29. Alternatively, third outer coupling sleeve 24 may be connected to variable position stabilizer 15 by welding or other suitable means of attachment, or third outer coupling sleeve 24 may be formed as an integral part of variable position stabilizer 15.

The longitudinal axes of sleeves 22, 23, and 24 may move with respect to each other, but remain parallel to each other and to the longitudinal axis of drive shaft 3. As used herein, an axis also is considered to be parallel to itself; thus, two elements sharing a common axis are considered to have parallel axes. As described below in more detail, in some embodiments the longitudinal axes of the sleeves may be permitted to be deviate from being parallel to each other.

Referring to FIG. 3, first outer coupling sleeve 22 has a pair of diametrically opposed tabs 30, which are designed to engage a pair of complementary, diametrically opposed grooves 31 in second outer coupling sleeve 23. As used herein, a tab and groove are considered complimentary if they have substantially the same cross section in the portion in which they engage each other but are the complement of each other in that portion. Second outer coupling sleeve 23 also has a diametrically opposed pair of grooves 32, which are designed to engage a pair of complementary, diametrically opposed tabs 33 in third outer coupling sleeve 24. The diametrical chord between the pair of grooves 31 is perpendicular to the diametrical chord between the pair of grooves 32.

It is understood that, in other embodiments, there may be more than a single pair of tabs and grooves which engage adjacent sleeves, and that such tabs and grooves need not be diametrically opposed. By way of example, there may be two pairs of tabs and grooves which are spaced apart from each other but all of the grooves between two adjacent sleeves are parallel and all are orthogonal to the grooves between the other pair of adjacent sleeves.

Tabs 30 engage grooves 31 and are capable of transmitting torque between first outer coupling sleeve 22 and second outer coupling sleeve 23. Similarly, tabs 33 engage grooves 32 and are capable of transmitting torque between second outer coupling sleeve 23 and third outer coupling sleeve 24.

Tabs 30 are free to slide along grooves 31, so that sleeves 22 and 23 are free to move relative to each other in a direction transverse to the longitudinal axes of these sleeves. Similarly, tabs 33 are free to slide in grooves 32, so that sleeve 23 and 24 are free to move relative to each other in a direction transverse to the longitudinal axes of these sleeves which also is orthogonal to the direction in which sleeve 23 is free to move with respect to sleeve 22.

Thus, the longitudinal axes of sleeves 22 and 23 may be displaced a limited distance from each other, the limited distance being determined by the relative positions of each longitudinal axis and the radial dimensions of tabs 30 and grooves 31. Similarly, the longitudinal axes of sleeves 23 and 24 may be displaced a limited distance from each other, the limited distance being determined by the relative positions of each longitudinal axis and the radial dimensions of tabs 33 and grooves 32. Because the direction of movement between sleeves 22 and 23 is orthogonal with respect o the direction of movement between sleeves 23 and 24, sleeves 22 and 24 may be displaced a limited distance in any radial direction (i.e., perpendicular to the longitudinal axis of the two sleeves) while the tabs and grooves of the coupling remain engaged with each other, which permits torque to be transmitted through the coupling.

Thus, variable position stabilizer 15 is free to move a limited distance with respect to intermediate outer housing 20 in any direction perpendicular to their respective longitudinal axes while still being rotationally linked. Because drive shaft 3 and the intermediate outer housing 20 share a common longitudinal axis, variable position stabilizer 15 also is free to move a limited distance with respect to drive shaft 3 in any radial direction (i.e., perpendicular to their respective longitudinal axes).

The radial position of variable position stabilizer 15 is adjustable using a pair of sleeves, each of which sleeves has an eccentric bore.

Referring to FIGS. 2 and 4A, inner eccentric sleeve 40 and outer eccentric sleeve 41 are used to adjust the radial position of variable position stabilizer 15. Inner eccentric sleeve 40 has an eccentric bore 42. The center of the cylindrical bore 42 through inner eccentric sleeve 40 is located at $C_1$ in FIG. 4A (which also corresponds to the location of the longitudinal axis of drive shaft 3). However, the center of the cylindrical exterior surface of inner eccentric sleeve 40 is located at $C_2$ in FIG. 4A. Inner eccentric sleeve 40 is supported on drive shaft 3 by radial bearings 45. Thus, bore 42 through inner eccentric sleeve 40 is concentric with the cylindrical exterior surface 46 of drive shaft 3, but the cylindrical exterior surface of eccentric sleeve 40 is not concentric with the cylindrical exterior surface of drive shaft 3.

The center of the cylindrical bore 43 through outer eccentric sleeve 41 is located at $C_2$ in FIG. 4A. However, the center of the cylindrical exterior surface of outer eccentric sleeve 41 is located at $C_1$ in FIG. 4A. Outer eccentric sleeve 41 is supported on inner eccentric sleeve 40 by radial bearings 46. Thus, bore 43 through outer eccentric sleeve 41 is concentric with the cylindrical exterior surface of inner eccentric sleeve 40. Depending on the relative orientations of inner eccentric sleeve 40 and outer eccentric sleeve 41, the cylindrical exterior surface of outer eccentric sleeve 41 may or may not be concentric with the cylindrical exterior surface 46 of drive shaft 3.

Referring to FIG. 2, variable position stabilizer 15 is supported on outer eccentric sleeve 41 by radial bearings 58. The inner cylindrical surface of variable position stabilizer 15 remains concentric with the exterior cylindrical surface of outer eccentric sleeve 41. A change in the position of the exterior cylindrical surface of outer eccentric sleeve 41 as a result a change on the respective orientations of inner eccentric sleeve 40 and outer eccentric sleeve 41 will effect a change in the position of the variable position stabilizer 15, as discussed in more detail below.

Inner eccentric sleeve 40 is held in its longitudinal position by nut 50, which engages a threaded portion 51 of the exterior surface of drive shaft 3 and abuts bearing assembly 52, which in turn abuts shoulder 53 on inner eccentric sleeve 40.

Outer eccentric sleeve 41 is held in its longitudinal position by shoulder 54 on inner eccentric sleeve 40, which abuts washer 55, which in turn abuts shoulder 56 on outer eccentric sleeve 41.

Drive shaft 3, inner eccentric sleeve 40, outer eccentric sleeve 41, and variable position stabilizer 15 are all free to rotate independently of each other. However, rotation of inner eccentric sleeve 40 and/or outer eccentric sleeve 41 will result in a change in the position of variable position stabilizer 15.

Inner eccentric sleeve 40 can be rotated by rotation of inner drive sleeve 70. Inner drive sleeve 70 is rotated by a first motor and the drive train associated with such motor in response to control signals received or generated by directional drilling tool 1. Inner drive sleeve 70 is concentric to drive shaft 3. Inner drive sleeve 70 is connected to inner transfer sleeve 71 by a set of splines 72 which engage a complementary set of splines 73 on inner transfer sleeve 71. Inner transfer sleeve 71 is connected to inner eccentric sleeve 40 by a set of splines 74 on inner transfer sleeve 71 which engage a complementary set of splines 75 on a cylindrical sleeve 76 which is (i) concentric to bore 42 through eccentric sleeve 40 and (ii) rigidly connected to or integrally formed with inner eccentric sleeve 40. Because bore 42 through inner eccentric sleeve 40 is concentric with drive shaft 3 and therefore concentric with inner drive sleeve 70, this is easily done.

More of a challenge is presented in connecting outer eccentric sleeve 41 to a source of rotational power because bore 43 through outer eccentric sleeve 41 is not concentric with drive shaft 3. Outer eccentric sleeve 41 can be rotated by rotation of outer drive sleeve 80. Outer drive sleeve 80 is rotated by a second motor and associated drive train in response to control signals received or generated by directional drilling tool 1. Outer drive sleeve 80 is concentric to drive shaft 3. Outer drive sleeve 80 is connected to outer transfer sleeve 81 by a set of drive pins 82. The other end of outer transfer sleeve 81 is connected to an inner eccentric coupling 25, shown in FIGS. 2 and 3.

Referring to FIGS. 2 and 3, the second concentric coupling 25 is comprised of three sleeves—a first inner coupling sleeve 85, a second inner coupling sleeve 86, and a third inner coupling sleeve 87.

In the embodiment shown, first inner coupling sleeve 85 has a set of splines 90 which engage a complementary set of splines 91 on outer transfer sleeve 81. Alternatively, first inner coupling sleeve 85 may be connected to outer transfer sleeve 81 by welding or other suitable means of attachment. Alternatively, first inner coupling sleeve 85 may be formed as an integral part of outer transfer sleeve 81.

In the embodiment shown, third inner coupling sleeve 87 is connected to outer eccentric sleeve 41 by a set of fingers 92 on third inner coupling sleeve 87 which engage a complementary set of fingers 93 which is connected to outer eccentric sleeve 41. A web or ring of material 94 extends across the ends of fingers 92 to maintain suitable spacing between fingers 92 and protect against inadvertent bending of fingers 92. Apertures 95 between fingers 92 permit ready visual inspection during assembly of proper engagement between fingers 92 and fingers 93.

Alternatively, third inner coupling sleeve 87 may be connected to outer eccentric sleeve 41 by welding or other suitable means of attachment, or may be formed as an integral part of outer eccentric sleeve 41.

Referring to FIG. 3, first inner coupling sleeve 85 has a pair of diametrically opposed tabs 100, which are designed to engage a pair of complementary, diametrically opposed grooves 101 in second inner coupling sleeve 86. Second inner coupling sleeve 86 also has a diametrically opposed pair of grooves 102, which are designed to engage a pair of complementary, diametrically opposed tabs 103 in third inner coupling sleeve 87. The diametrical chord between the pair of grooves 101 is perpendicular to the diametrical chord between the pair of grooves 102, i.e., grooves 101 are orthogonal to the grooves 102.

Tabs 100 engage grooves 101 and are capable of transmitting torque between first inner coupling sleeve 85 and second inner coupling sleeve 86. Similarly, tabs 103 engage grooves 102 and are capable of transmitting torque between second inner coupling sleeve 86 and third inner coupling sleeve 87.

Tabs 100 are free to slide along grooves 101, so that sleeves 85 and 86 are free to move relative to each other in a direction transverse to the longitudinal axes of these sleeves. Similarly, tabs 103 are free to slide in grooves 102, so that sleeve 86 and 87 are free to move relative to each other in a direction transverse to the longitudinal axes of these sleeves which also is orthogonal to the direction in which sleeve 85 is free to move with respect to sleeve 86.

Thus, the longitudinal axes of sleeves 85 and 86 may be displaced a limited distance from each other, the limited distance being determined by the relative positions of each longitudinal axis and the radial dimensions of tabs 100 and grooves 101. Similarly, the longitudinal axes of sleeves 86 and 87 may be displaced a limited distance from each other, the limited distance being determined by the relative positions of each longitudinal axis and the radial dimensions of tabs 103 and grooves 102. Because the direction of movement between sleeves 85 and 86 is orthogonal with respect to the direction of movement between sleeves 86 and 87, sleeves 85 and 87 may be displaced a limited distance in any direction perpendicular to the longitudinal axis of the two sleeves while the tabs and grooves of the coupling remain engaged with each other, which permits torque to be transmitted through the coupling.

Thus, the longitudinal axis of outer eccentric sleeve 41 is free to move a limited distance with respect to longitudinal axis of outer transfer sleeve 81 in any radial direction (i.e., perpendicular to the longitudinal axis of the two sleeves) while the tabs and grooves of the coupling remain engaged with each other, which permits torque to be transmitted through the coupling.

Referring to FIG. 4A, variable position stabilizer 15 is shown in its "neutral" position; i.e., the exterior surfaces of the blades 16 are concentric with drive shaft 3 and drill bit 7. The diameter of variable position stabilizer 15 measured across diametrically opposing blades 16 is only slightly smaller than the diameter of drill bit 7 and the borehole drilled by drill bit 7.

When variable position stabilizer 15 is in its neutral position, it does not exert any radial force on drill bit 7. However, when the longitudinal axis of variable position stabilizer 15 is radially displaced sufficiently, blades 16 contact the wall of the borehole and begin to apply a radial force on drive shaft 3 and drill bit 7, which will result in a deviation in the direction of drilling in the direction of the radial force being applied. The magnitude of the radial force being applied to the drill bit will affect the magnitude of the rate of change of the deviation.

Variable position stabilizer 15 need not rotate, but is free to engage the wall of the borehole and remain stationary while drive shaft 3 rotates drill bit 7.

Figure 4B:
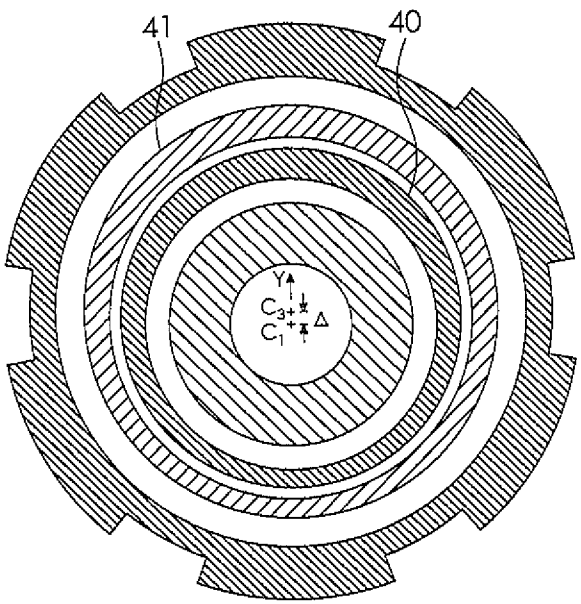
FIG. 4B is a transverse cross-sectional view similar to FIG. 4A showing the radial displacement in the Y direction of the variable position stabilizer as a result of rotation of the inner and outer eccentric sleeves.
Figure 4A:
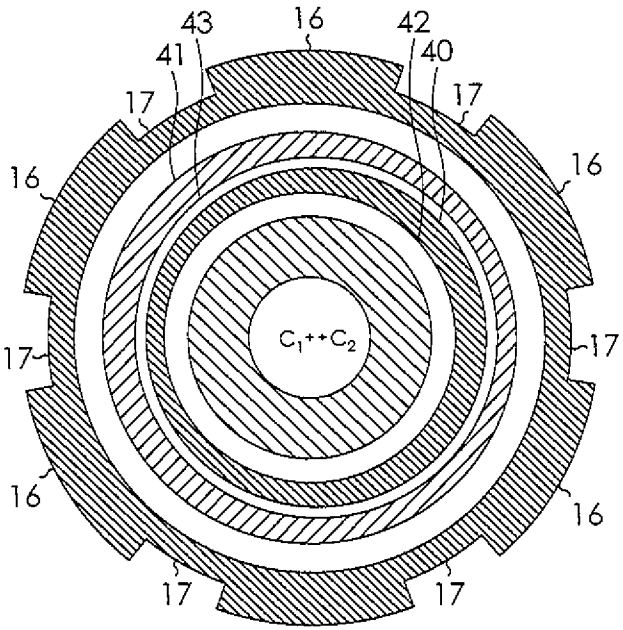
FIG. 4A is a transverse cross-sectional view of the embodiment shown in FIG. 2.

Referring to FIG. 4B, inner eccentric sleeve 40 has been rotated counterclockwise 90° and outer eccentric sleeve 41 has been rotated clockwise 90°. This results in a radial shift of the longitudinal axis of the variable position stabilizer 16 from location $C_1$ to location $C_3$. This is a shift in the Y direction by an amount Δ.

In the various embodiments of the invention, (i) each eccentric coupling is comprised of three sleeves; (ii) there is at least one complementary tab/groove set comprised of a pair of tabs and a pair of grooves tab where the first sleeve engages the second sleeve, and at least one complementary tab/groove set comprised of a pair of tabs and a pair of grooves tab where the second sleeve engages the third sleeve; and (iii) a chord connecting the centers of each of the pair of tabs (or grooves) for the set between the first and second sleeves is orthogonal to a chord connecting the centers of each pair of tabs (or grooves) for the set between the second and third sleeves. In the embodiments previously shown, the tabs were on the first and third disks and the grooves were on both sides of the second disc. However, it is understood that, in other embodiments of the invention, the locations of the tabs and grooves may be reversed for any or all of the sets of tabs and grooves.

Figure 6:
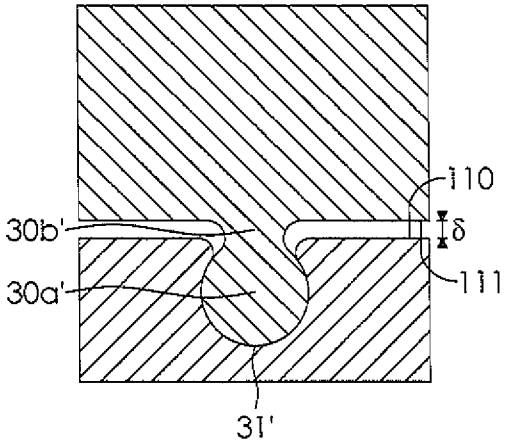
FIG. 6 is a cross-sectional view of another embodiment of the complementary tab and groove set in which the tab has a narrow and elongated neck compared to the neck of the complementary groove.
Figure 5:
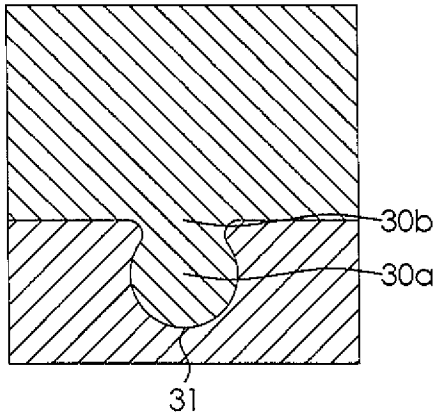
FIG. 5 is a cross-sectional view of an embodiment of the complementary tab and groove set associated with the first and second outer coupling sleeves.

In the embodiments previously shown, the tabs have a neck portion and a circular lobe portion. Referring to FIG. 5, in some embodiments, the circular lobe portion 30*a* and the neck portion 30*b* of the tabs have the same cross-sectional profile as the corresponding groove 31. Referring to FIG. 6, it is understood that, in other embodiments, the tab may have an elongated, more narrow neck portion 30*b*', although the diameter of the circular lobe portion 30*a*' of the tab remains essentially the same as that of the groove 31'. While the cross-section of the tab and the associated groove are no longer identical, they are considered to be complementary for the purposes of this invention. The only portion of the tab which engages the groove 31' is the circular lobe portion 30*a*', and the cross section of the circular lobe portion 30*a*' is essentially the same as the cross section of that part of the groove 31' which it engages.

As a result of making the neck portion of the tab more narrow and more elongated that the corresponding portion of the groove, there may be a small space 6 created between the opposing faces 110 and 111 of adjacent sleeves when the tabs are engaged in the associated grooves. Because both the circular lobe portion of the tab and the circular lobe portion of the groove which it engages have substantially the same diameter, the tab can now rotate slightly in the groove. For embodiments of the eccentric coupling having sleeves with a diameter of about 120 mm and an space or offset 6 between the faces of adjacent sleeves of about 1 mm, the space or offset will permit the tab and groove to rotate about 1°.

For embodiments in which the tabs have such a narrow and elongated neck, the longitudinal axes of the sleeves are not required to be parallel, but instead may vary by an amount within the ability of the tab and groove to rotate with respect to each other. In such embodiments, the eccentric coupling can perform the function of a universal joint to a limited extent.

It also is understood that the shape of the tabs and grooves may not have a circular lobe, but may have other complementary shapes. Depending on the shape used for the tab and groove, such as a rectangle, adjacent sleeves of the coupling may be separated by simply pulling the adjacent sleeves longitudinally in opposite directions. For other shapes, such as the circular lobe and neck, adjacent sleeves cannot be separated by merely pulling the adjacent sleeves longitudinally in opposite directions, but instead must be moved sideways (i.e., in a direction transverse to longitudinal axis of the sleeves) to slide the tabs out of the grooves.

What is claimed is:

1. A directional drilling tool comprising:

a drive shaft having a longitudinal bore;

a variable position stabilizer, the variable position stabilizer being a sleeve movable radially with respect to a longitudinal axis of the drive shaft;

an inner eccentric sleeve having an eccentric bore, the drive shaft disposed inside the bore of said inner sleeve, the inner sleeve rotatable relative to and concentric with the drive shaft;

an outer eccentric sleeve having an eccentric bore, the inner sleeve disposed inside the bore of said outer sleeve, the outer sleeve rotatable relative to and not concentric with the drive shaft, the outer eccentric sleeve disposed inside the variable position stabilizer, wherein the radial position of said variable position stabilizer is adjusted by relative rotation of said outer eccentric sleeve and said inner eccentric sleeve; and an eccentric coupler comprising:

a first coupler sleeve, the first coupler sleeve mechanically coupled with an outer drive sleeve, the outer drive sleeve rotatable by a first motor, the outer drive sleeve concentric with the drive shaft;

a second coupler sleeve;

a first complementary tab and groove set, comprising at least one pair of diametrically opposed tabs and one pair of diametrically opposed grooves configured to transmit torque between said first coupler sleeve and said second coupler sleeve, the tabs slidable within the grooves in a direction transverse to a longitudinal axis of the first coupler sleeve and a longitudinal axis of the second coupler sleeve;

a third coupler sleeve, the third coupler sleeve mechanically coupled to the outer eccentric sleeve; and a second complementary tab and groove set, comprising at least one pair of diametrically opposed tabs and one pair of diametrically opposed grooves configured to transmit torque between said second coupler sleeve and said third coupler sleeve, the tabs slidable within the grooves in a direction transverse to the longitudinal axis of the second coupler sleeve and a longitudinal axis of the third coupler sleeve, wherein the grooves of said second complementary tab and groove set are orthogonal to the grooves of said first complementary tab and groove set.

2. The directional drilling tool of claim 1 wherein said eccentric coupler transmits torque to said outer eccentric sleeve having an eccentric bore to adjust the position of said variable position stabilizer.

3. The directional drilling tool of claim 1 wherein each tab of said first and second complementary tab and groove sets has a circular lobe portion and a narrow extended neck portion configured such that there is a space between the opposing faces of their associated sleeves permitting each tab to rotate to a limited extent when engaged in its complementary groove.

4. The directional drilling tool of claim 1, wherein the inner eccentric sleeve is mechanically coupled to an inner drive sleeve rotatable by a second motor, the inner drive sleeve concentric with the drive shaft.

5. The directional drilling tool of claim 1, wherein the outer drive sleeve is mechanically coupled to the first coupler sleeve by a set of splines.

6. The directional drilling tool of claim 1, wherein the third coupler sleeve is mechanically coupled to the outer eccentric sleeve by a set of fingers on the third coupler sleeve which engage a set of fingers of the outer eccentric sleeve.

7. The directional drilling tool of claim 1, wherein the first and second coupler sleeves and the second and third coupler sleeves are free to move relative to each other in a direction transverse to the longitudinal axes of the respective sleeves.

8. The directional drilling tool of claim 1, further comprising one or more radial bearings positioned between the drive shaft and the inner eccentric sleeve, between the inner eccentric sleeve and the outer eccentric sleeve, between the outer eccentric sleeve and the variable position stabilizer, or combinations thereof.

9. A directional drilling tool comprising:

a drive shaft having a longitudinal bore;

a variable position stabilizer, the variable position stabilizer being a sleeve movable radially with respect to a longitudinal axis of the drive shaft;

an inner eccentric sleeve having an eccentric bore, the drive shaft disposed inside the bore of said inner sleeve, the inner sleeve rotatable relative to and concentric with the drive shaft;

an intermediate outer housing, the intermediate outer housing having a longitudinal axis in common with the drive shaft;

an outer eccentric sleeve having an eccentric bore, the inner sleeve disposed inside the bore of said outer sleeve, the outer sleeve rotatable relative to and not concentric with the drive shaft, the outer eccentric sleeve disposed inside the variable position stabilizer, wherein the radial position of said variable position stabilizer is adjusted by relative rotation of said outer sleeve and said inner sleeve;

a first eccentric coupler comprising:

a first coupler sleeve, the first coupler sleeve mechanically coupled with an outer drive sleeve, the outer drive sleeve rotatable by a first motor, the outer drive sleeve concentric with the drive shaft;

a second coupler sleeve;

a first complementary tab and groove set, comprising at least one pair of diametrically opposed tabs and one pair of diametrically opposed grooves configured to transmit torque between said first coupler sleeve and said second coupler sleeve, the tabs slidable within the grooves in a direction transverse to a longitudinal axis of the first coupler sleeve and a longitudinal axis of the second coupler sleeve;

a third coupler sleeve, the third coupler sleeve mechanically coupled to the outer eccentric sleeve; and a second complementary tab and groove set, comprising at least one pair of diametrically opposed tabs and one pair of diametrically opposed grooves configured to transmit torque between said second coupler sleeve and said third coupler sleeve, the tabs slidable within the grooves in a direction transverse to the longitudinal axis of the second coupler sleeve and a longitudinal axis of the third coupler sleeve, wherein the grooves of said second complementary tab and groove set are orthogonal to the grooves of said first complementary tab and groove set; and a second eccentric coupler comprising:

a fourth coupler sleeve, the fourth coupler sleeve mechanically coupled to the intermediate outer housing;

a fifth coupler sleeve;

a third complementary tab and groove set, comprising at least one pair of diametrically opposed tabs and one pair of diametrically opposed grooves configured to transmit torque between said fourth coupler sleeve and said fifth coupler sleeve, the tabs slidable within the grooves in a direction transverse to a longitudinal axis of the fourth coupler sleeve and a longitudinal axis of the fifth coupler sleeve;

a sixth coupler sleeve, the sixth coupler sleeve coupled to the variable position stabilizer; and a fourth complementary tab and groove set, comprising at least one pair of diametrically opposed tabs and one pair of diametrically opposed grooves configured to transmit torque between said fifth coupler sleeve and said sixth coupler sleeve, the tabs slidable within the grooves in a direction transverse to the longitudinal axis of the fifth coupler sleeve and a longitudinal axis of the sixth coupler sleeve, wherein the grooves of said fourth complementary tab and groove set are orthogonal to the grooves of said third complementary tab and groove set.

10. The directional drilling tool of claim 9 wherein one of the first and second eccentric coupler transmits torque to said outer eccentric sleeve having an eccentric bore to adjust the position of said variable position stabilizer.

11. The directional drilling tool of claim 9 wherein the tabs of at least one of said complementary tab and groove sets has a circular lobe portion and a narrow extended neck portion configured such that there is a space between the opposing faces of their associated sleeves permitting each tab to rotate to a limited extent when engaged in its complementary groove.

12. The directional drilling tool of claim 9, wherein the inner eccentric sleeve is mechanically coupled to an inner drive sleeve rotatable by a second motor, the inner drive sleeve concentric with the drive shaft.

13. The directional drilling tool of claim 9, wherein the outer drive sleeve is mechanically coupled to the first coupler sleeve by a set of splines.

14. The directional drilling tool of claim 9, wherein the third coupler sleeve is mechanically coupled to the outer eccentric sleeve by a set of fingers on the third coupler sleeve which engage a set of fingers of the outer eccentric sleeve.

15. The directional drilling tool of claim 9, wherein the fourth coupler sleeve is mechanically coupled to the intermediate outer housing by a set of splines, welding, or a threaded connection.

16. The directional drilling tool of claim 9, wherein the sixth coupler sleeve is coupled to the variable position stabilizer by a threaded connection or welding.

17. The directional drilling tool of claim 9, wherein the sixth coupler sleeve is formed as an integral part of the variable position stabilizer.

18. The directional drilling tool of claim 9, wherein the first, second, fourth, and fifth coupler sleeves are free to move relative to the second, third, fifth, and sixth coupler sleeves respectively in a direction transverse to the longitudinal axes of the respective sleeves.

19. The directional drilling tool of claim 9, further comprising one or more radial bearings positioned between the drive shaft and the inner eccentric sleeve, between the inner eccentric sleeve and the outer eccentric sleeve, between the outer eccentric sleeve and the variable position stabilizer, or combinations thereof.

20. The directional drilling tool of claim 9, wherein the variable position stabilizer is movable relative to the intermediate outer housing and is rotationally linked to the intermediate outer housing.

* * * * *